US007703226B2

(12) United States Patent
Schnuckle

(10) Patent No.: US 7,703,226 B2
(45) Date of Patent: Apr. 27, 2010

(54) CONTAINER WITH REFLECTIVE SURFACE FOR CREATING A MULTI-EFFECT VISUAL DISPLAY

(75) Inventor: Gary Schnuckle, Altadena, CA (US)

(73) Assignee: Alameda Technology, LLC, Burbank, CA (US)

( * ) Notice: Subject to any disclaimer, the term of this patent is extended or adjusted under 35 U.S.C. 154(b) by 272 days.

(21) Appl. No.: 11/463,951

(22) Filed: Aug. 11, 2006

(65) Prior Publication Data

US 2008/0034628 A1 Feb. 14, 2008

(51) Int. Cl.
*G09F 3/00* (2006.01)

(52) U.S. Cl. ..... 40/310; 359/439

(58) Field of Classification Search ..... 40/310, 40/306; 215/365, 366; 359/436, 439, 440
See application file for complete search history.

(56) References Cited

U.S. PATENT DOCUMENTS 2,810,978 A * 10/1957 Chapman ..... 40/310
4,094,501 A 6/1978 Burnett
4,115,939 A * 9/1978 Marks ..... 40/310
4,613,128 A 9/1986 Lasky
5,139,455 A 8/1992 Israel
5,229,884 A 7/1993 Kelderhouse et al.
5,257,130 A 10/1993 Monroe
5,476,194 A * 12/1995 Hippely et al. ..... 222/192
D375,678 S 11/1996 Owsiany
5,676,401 A 10/1997 Witkowski et al.
5,695,346 A 12/1997 Sekiguchi et al.
5,758,440 A * 6/1998 Yudin ..... 40/310
5,782,547 A 7/1998 Machtig et al.
5,782,698 A 7/1998 Keller
5,787,618 A 8/1998 Mullis
5,788,579 A 8/1998 Cherry et al.
5,799,939 A 9/1998 Schneider
5,871,404 A 2/1999 Weinreich
5,884,421 A * 3/1999 Key ..... 40/306
5,951,405 A 9/1999 Eigenmann
6,050,011 A 4/2000 Hess et al.
6,050,414 A 4/2000 Saffron et al.
6,080,067 A 6/2000 Leff (Continued)

OTHER PUBLICATIONS

PCT/US07/69866 International Search Report, Aug. 27, 2008.

(Continued)

*Primary Examiner*—Joanne Silbermann
(74) *Attorney, Agent, or Firm*—Marsh Fischmann & Breyfogle LLP; Kent A. Lembke

(57) ABSTRACT

A container for creating a multi-dimensional visual display or illusion. The container includes sidewall and a visual display assembly mounted on an exterior surface of the sidewall. The display assembly may be provided in one or more labels attached to the exterior surface and includes a reflective surface attached to a rear portion of the sidewall. A primary image is positioned between the reflective surface and exterior surface of the sidewall. The sidewall is curved and the reflective surface and primary image are mounted to conform to this curved shape. A framing element is provided on a front portion of the sidewall with background images on an inward facing surface. The framing element includes a view port providing a line of sight through the container onto the primary image and reflective surface, which reflects the background images to the viewer so as to appear behind the primary image.

29 Claims, 9 Drawing Sheets

U.S. PATENT DOCUMENTS

| | | | | |
|---|---|---|---|---|
| 6,135,654 | A * | 10/2000 | Jennel | 400/61 |
| 6,272,777 | B1 * | 8/2001 | Swenson | 40/310 |
| 6,336,725 | B1 | 1/2002 | Cianfichi, Jr. | |
| 6,581,972 | B2 * | 6/2003 | Nojima et al. | 283/81 |
| D479,132 | S * | 9/2003 | Boutilier | D9/550 |
| 6,622,878 | B1 * | 9/2003 | Frey | 215/12.2 |
| 6,943,953 | B2 | 9/2005 | Raymond | |
| 6,945,872 | B2 | 9/2005 | DeVogel | |
| 6,976,678 | B1 | 12/2005 | Setteducati | |
| 7,001,033 | B1 | 2/2006 | Olsen et al. | |
| 7,010,877 | B2 * | 3/2006 | Geary | 40/310 |
| 7,016,116 | B2 | 3/2006 | Dolgoff | |
| 7,057,823 | B1 | 6/2006 | Raymond | |
| 2005/0075176 | A1 | 4/2005 | DeVogel | |
| 2005/0083676 | A1 | 4/2005 | VanderSchuit | |

OTHER PUBLICATIONS

Notification of Transmittal of International Search Report and the Written Opinion of the International Searching Authority, or the Declaration, PCT/US07/69857, Dec. 21, 2007.

Optigone Associates, Mirage Model 22 Gigantic 3D Hologram Maker, www.optigone.com, Jun. 20, 2006.

* cited by examiner

CONTAINER WITH REFLECTIVE SURFACE FOR CREATING A MULTI-EFFECT VISUAL DISPLAY

CROSS-REFERENCE TO RELATED APPLICATIONS

This application is related to co-pending U.S. patent application Ser. No. 11,463,941, filed with this application, and entitled "Optical Illusion Device," which is incorporated herein in its entirety by reference.

BACKGROUND OF THE INVENTION

1. Field of the Invention

The present invention relates, in general to packaging and labeling techniques that produce objects such as containers with imagery that is appealing to consumers, and, more particularly, to containers, and methods for manufacturing such containers, that are labeled in a manner that for a viewer produces an image that appears displaced from the container's surfaces or a composite image that has multi-dimensions or layers such as a foreground image, a primary or central image, and a background image.

2. Relevant Background

Companies marketing their products are continuously searching for better ways to differentiate their product from competitors' products on crowded retail shelves. This is particularly true for products that may be similar in taste, appearance, or other characteristics such as water, alcoholic and non-alcoholic beverages, and many other consumer products including shampoo, liquid soap, and the like. To differentiate their products, these companies have turned to packaging to try to create increased shelf appeal and cause a consumer to select their product over a competitor's product at the point of sale or point of purchase. For example, shrink sleeve labels, wrap-around labels, or other labels may be used to package a consumer product container and include colorful images or eye-catching graphics that are intended to attract a consumer and cause them to purchase the product. A product's packaging is particularly important for products that may be selected based on price or for other factors other than brand loyalty and for products that are new to a market. In these cases, consumers often will select one product over another simply due to the way it is packaged.

Products are often packaged in bottles, cans, jars, cups, and/or containers that have an unusual shape such as placing syrup in a bottle having the shape of a person or of a log cabin. Alcoholic beverages such as vodka may also come in unique shapes to attract a consumer's attention. More commonly, a container or bottle with a standard shape is used but labels that are colorful or include colorful or graphic images are applied to attract consumers. For example, recent packaging innovations include labels for clear liquid containers that are adapted to allow a consumer to view an image through the container walls and the liquid in the container with the image appearing affixed on the container wall. With these containers, an image may be printed on a label that is attached to the back of the container or an image may be printed directly onto the back side of the container. In some containers, wraparound labels are applied that include text on the interior surfaces that is visible through a clear liquid in the container or is visible after a more opaque liquid is removed (e.g., to provide contest results or other information after a beverage is consumed). Packaging for containers may even include labels with lens materials to magnify an image, to create a three dimensional image, and/or to create a moving image. An ongoing challenge is to develop packaging innovations that achieve new effects or imagery with little or no increase in the cost of the packaging.

There continues to be a demand for innovative packaging designs and techniques that increase the shelf appeal of consumer products. Such packaging designs and techniques will provide differentiating imagery or graphics for a product container while controlling added packaging costs. In some cases, it may be desirable that the packaging designs and techniques in accordance with the present invention be integrated with existing packaging and/or labeling processes to control tooling or manufacturing costs.

SUMMARY OF THE INVENTION

The present invention addresses the above problems by providing containers (and methods of manufacturing such containers) that are adapted for creating multi-dimensional displays that significantly enhance the shelf appeal of these containers. The invention also provides one or more labels or other visual display assemblies that may be attached to containers or other objects. Generally, the containers each include a reflector or reflective surface on a rear side of the clear or translucent container (e.g., a plastic, ceramic, or glass bottle, jar, box, or other container). A central or primary image is printed on this reflective surface or otherwise provided on the rear side of the container or the reflective surface. A framing element is provided on the front side of the container, and this framing element includes an image pattern and a clear viewing port or window (with "port" or "window" being any portion of the framing element through which a viewer's line of sight is directed and not being limited to a complete or enclosed frame/boundary). The framing element may include well-defined images or image patterns or simply provide an image obscuring area defining a non-image obscuring area providing the viewing port (e.g., an opaque or translucent surface such as that may be achieved with frosting or sandblasting a surface while leaving a portion clear or substantially transparent). The image pattern may include background images abutting the container exterior surface, and the view port directs a viewer's line of sight toward the rear side of the container and the reflective surface and the primary image. Foreground images may be provided by viewing the outward facing side of the background images or with additional printed images provided on the framing element. In this way, the container effectively generates a multi-dimensional graphic or display because a viewer concurrently views the foreground image on the front side of the container, the central or primary image at the rear portion of the container on or in front of the reflective surface, and also the background images via the reflective surface. The background images appear to the viewer to be physically behind the primary or central image due to their location on the front side of the container and use of the reflective surface.

It is expected that the concepts of the invention for generating a surprisingly dynamic visual effect with a reflective surface will readily be adopted by the packaging industry in an attempt to differentiate products. This is due in part to the low added cost for the packaging concept as the reflective surface and images can readily be provided using printing and labeling techniques. For example, the images may be provided on or printed on two thin plastic labels or on a single wraparound label using rotogravure, flexographic printing, or other known printing technique. In some cases, the images may simply be printed or applied directly to a container sidewall. The concepts of the invention are applicable to nearly any clear or translucent-walled object such as glass, ceramic or plastic bottles, jars, cans, cups, and other containers used to contain products or to any container where a portion of the container is translucent or at least partially transparent (e.g., the container may only be translucent or substantially transparent where the reflective surface and the portion of the framing element providing the viewing port or window are positioned or provided). Likewise, the range of products that may be packaged using the display concepts are quite large and are expected to include water, health drinks, carbonated and alcoholic beverages, and other liquid or solid consumer products such as shampoo, soap, bubble bath, perfume, beauty products, and many other clear or translucent substances. Even opaque products could be packaged using these methods, where the visual effects can be visible after use or removal of the product. The invention may be thought of as "multi-effect" in that: the reflective surface creates a floating/centering effect for a primary image or object through reflected background image(s) and distortion; the optics of containers and objects configured according to the invention support this centering of a primary image and also may create an animation effect through point-of-view (POV) image shift and distortion. The optics of the containers or objects also create a disappearing effect by "erasing" the image between the mirror and sidewall through total internal reflection when the container or object is viewed through an off-angle surface (e.g., not viewed through the viewing port/window or framing element).

More particularly, a container is provided that is packaged or labeled for creating a desirable visual effect. The container includes a sidewall, a portion of which is formed of a substantially transparent material, and the sidewall defines an interior space for receiving a product (such as, but not limited to, a clear liquid). The sidewall includes a front portion and a rear portion distal to the front portion. The container may be sealed, have a removable lid or cap, or be an open-top cup. The container may be integrated with a dispenser mechanism such as an atomizer spray head, pump dispenser or the like (not shown). The container further includes a visual display assembly mounted on an exterior surface of the sidewall. In some embodiments, though, the visual display assembly or portions thereof are provided on an interior surface of the sidewall or within or as part of the sidewall. The display assembly may be provided in one or more labels attached to an exterior surface of the sidewall and includes a mirror element that is attached to the rear portion of the sidewall. The mirror element includes a reflective surface proximate to and, in some cases, abutting the exterior surface of the sidewall. A primary or central image (such as a printed/photographic image of a character, celebrity, or the like) is positioned or provided between the reflective surface and exterior surface of the sidewall. The primary image may be printed directly onto the reflective surface or it may be applied to the container sidewall. In certain embodiments, the sidewall at the rear portion is curved or an arc and the reflective surface and primary image are mounted on the sidewall so as to conform to the shape of the rear portion, e.g., to have a circular cross section. The container may further include a framing element on the front portion of the sidewall, and the framing element may include one or more background images printed on the exterior surface of the container or on an inner surface of the framing element. The framing element may also include a view port or window that is free of the background images and directs a viewer's line of sight through the container onto the reflective surface and the primary image, whereby the background images are concurrently reflected from the reflective surface.

In another aspect of the invention, a packaging system is provided for generating visual effects or illusions. The system includes a bottle having a sidewall with a portion that is at least translucent to light. A mirror element is mounted or deposited on a first portion of the sidewall that includes a surface that reflects light. The mirror element also includes a printed primary image on the reflective surface and this image is positioned proximate or contacting the first portion of the sidewall. The system further includes a printed background image abutting a second portion of the sidewall and spaced apart from the printed primary image. The background image may be selected for its symmetric characteristics or be printed as a mirror image so that it appears "correct" to a viewer in the reflective surface. In this manner, the background image is visible in the reflective surface and appears to be a distance behind the primary image to a viewer looking at the reflective surface through the front side of the bottle. A view port is also provided adjacent to the background image that is substantially transparent and typically positioned directly opposite the primary image across a void defined by inner surfaces of the sidewall. An opaque frame may be used to define the viewing port and foreground images can be printed on or otherwise provided on this opaque frame, and in these cases, the foreground image, the primary image, and the background image are all concurrently visible to a viewer as part of a composite display created by the packaging system.

In yet another aspect of the invention, a label is provided for generating a visual effect. The label includes a reflective element, a framing element, and a primary image. The primary image is positioned or provided proximate to the reflective element. The reflective element, the framing element, and the primary image are arranged on the label such that reflective element is positioned with respect to the framing element so that the primary image is viewable together with the reflection of the framing element through the framing element when the label is applied to an object. The object may take a number of forms such as a bottle, a cup, a can, a bowl, a different container a toy, a novelty product, or the like.

DETAILED DESCRIPTION OF THE PREFERRED EMBODIMENTS

Figure 1:
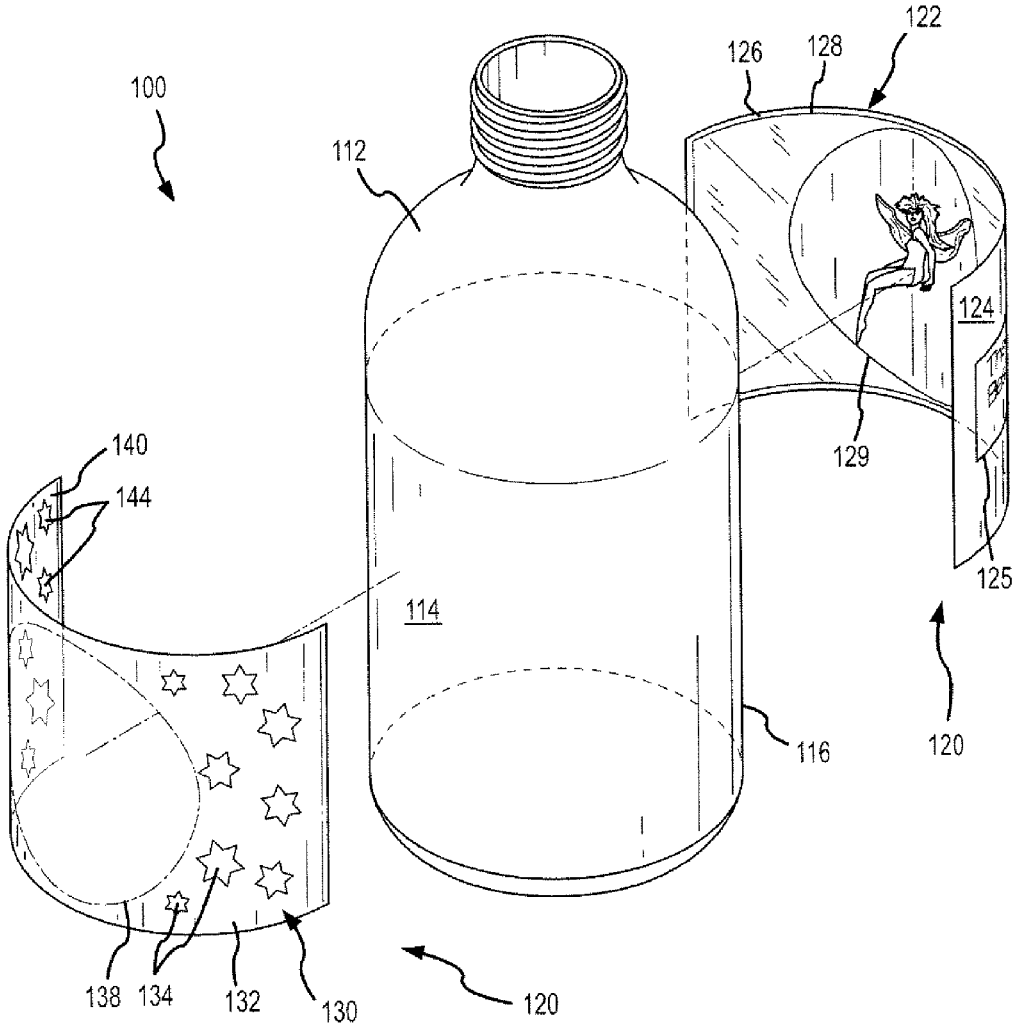
FIG. 1 is an exploded perspective view of a container with a visual display assembly of the present invention for generating an image or graphic display to a viewer outside the container.

Briefly, the present invention is directed to containers packaged or labeled to create an image that appears displaced from the container's surface. The invention is particularly well suited for use with containers that have substantially transparent or translucent walls (or at least a portion that is translucent or transparent) and that may be used to contain or hold clear or translucent liquids, but the invention is also useful for creating displays when the container is emptied, which makes it attractive for use with keepsake, promotional, and reusable containers. Containers according to the invention are able to achieve such floating or multidimensional (or "multi-effect") imaging by providing a visual display assembly on an exterior or interior surface, as an integral component of, or within a clear or translucent container sidewall (e.g., a clear or substantially clear plastic, ceramic, or glass sidewall).

The visual display assembly is made up of a mirror element provided on a rear portion of the sidewall (i.e., a substantially transparent or translucent portion of the sidewall) and may include an optional framing element provided on a front portion of the sidewall. The mirror element includes a reflective surface on its interior side that is placed proximate to the container sidewall. A central or primary image is positioned in front of the reflective surface, e.g., printed on this reflective surface, provided on the rear portion of the container sidewall to contact or be surrounded by the reflective surface, or sandwiched between the reflective surface and the container sidewall. The framing element includes a viewing window or port that is transparent and permits a viewer's line of sight to be toward the central image on or near the reflective surface. The framing element also includes background images that may be provided on the container sidewall or on an interior surface of a label (e.g., a front label or portion of a wraparound label) or sandwiched between the container sidewall and the framing element.

The background images are visible through the viewing window as they are reflected off of the reflective surface. The framing element may also include foreground images as separate printed images on an exterior surface of a label or as the reverse side of the printed image used to provide the background images. These foreground images are positioned about the viewing port and are visible from outside the container. In some embodiments, the container sidewall comprises contours such that the mirror element and framing element are curved or arcuate in cross section. In these embodiments, the sidewall contours may be smooth such as a circle or parabola or may be complex or discontinuous comprising curved and straight portions. The sidewall contours may be two-dimensional or three-dimensional. The resulting display comprises a composite image or display in which the foreground images appear in front of the central image, the central image appears to be on the rear wall or inside the container and the background images appear to be behind the central image. In many cases, the composite image creates an illusion that the primary image is displaced within the container as if it were floating in the container. The containers described herein are in this manner able to effectively create a multilayer or multidimensional display by providing a composite image by combining image components attached to a container in two sets or elements such as in two semi-cylindrical labels, as part of a wraparound label, and/or as a combination of printed and attached components. In some embodiments, the visual display is enhanced by optical effects provided by the label, the container wall, and also inclusion of clear or translucent liquids within the container between the framing element and the mirror element.

Further enhancements of the image are in some cases achieved by printing the images to account for distortions or optical effects due to the container wall, the curvature of the reflective surface, the refractive index and diameter (or width) of the container, and/or other optical parameters. For example, the primary or central image may be printed with less width (i.e., thinner) to account for optical effects that cause the image created to be wider than the printed image, and similarly, the background images may be pre-distorted by printing them with a width that is greater than desired in the visual display to account for optical effects that cause the viewed image to be narrower than the printed version.

The framing element may in some embodiments be formed by printing the foreground images on an opaque frame or background on an exterior surface of a label, with the background defining the clear viewing window (e.g., a circle, an oval, a square, or other useful shape for permitting or directing a viewer's line of sight onto the primary or central image). In these cases, the background images may be provided on the interior surface of a label behind the foreground images but typically not in the viewing window. In other embodiments, the framing element is provided on a clear label (e.g., on the interior surface of the label and/or on the exterior surface of the label) or formed directly on a container sidewall and includes a pattern that is visible both from the exterior of the container and through the viewing window due to reflection. In certain embodiments, the viewing window may not necessarily be a defined shape but simply be provided by the configuration of the printed pattern (e.g., a viewer can view the reflective surface and the primary image and background image through clear portions of the pattern and these clear portions make up the viewing window or portal in these embodiments).

Figure 2:
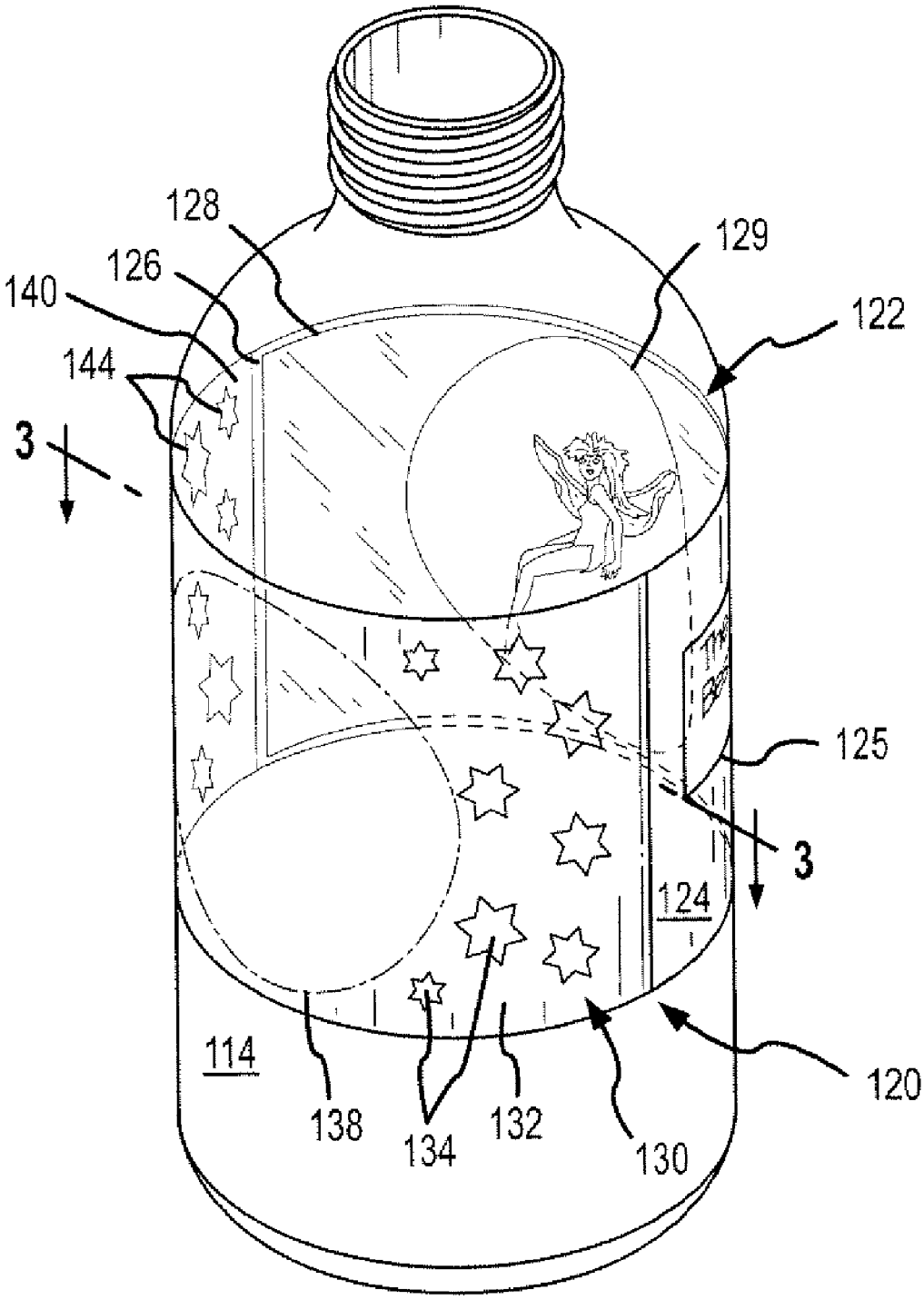
FIG. 2 illustrates the container of FIG. 1 in assembled form.
Figure 3:
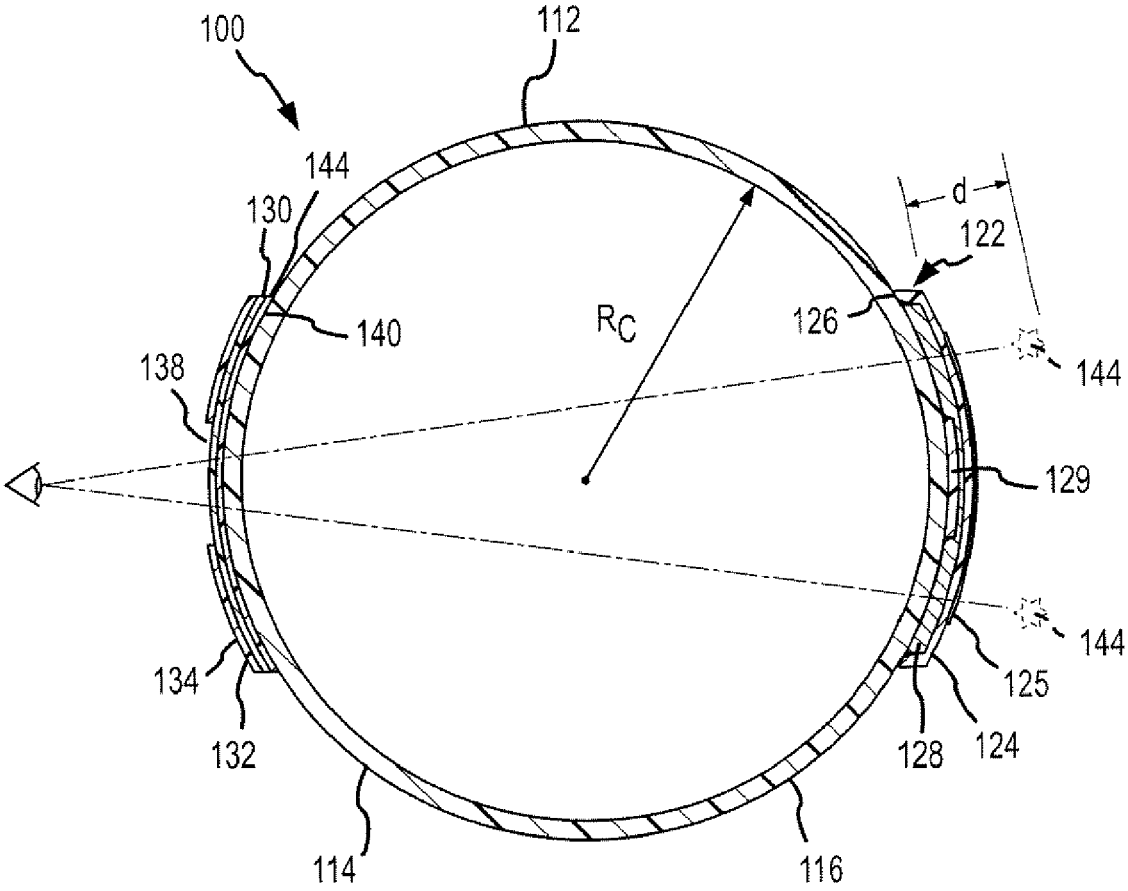
FIG. 3 is a cross sectional view of the container of FIGS. 1 and 2 taken at line 3-3 of FIG. 2 showing a lines of sight or viewing for a viewer through a view port or window of the visual display assembly to a reflective surface containing a primary or central image.

FIGS. 1-3 illustrate one embodiment of a container 100 designed according to the invention for displaying images using a reflective surface. As shown, the container 100 includes a sidewall 112 with a first or front portion 114 and a second or rear portion 116. Of course, the designation of "front" and "rear" for a container or other object may be relatively arbitrary and should not be considered limiting of the invention with the intent being to describe two generally opposing portions, such as sidewalls, of a container or object. The sidewall 112 is used to form a bottle or jar (e.g., a standard water or beverage bottle, a consumer product container, or the like) with a cylindrical cross section with a radius $R_C$. The shape of such bottle or jar may take many forms to practice the invention and the radius $R_C$ may also vary widely, such as 0.25 inches to a few inches to up to a foot or more. The sidewall 112 typically is formed of clear or translucent materials such as clear or lightly colored plastic, ceramic, or glass. Sidewall 112 may be single walled or comprise multiple walls. The thickness of the sidewall 112 is not limiting to the invention but its thickness and material properties are typically considered in achieving a desired visual effect (e.g., by considering the refractive index of the container sidewall 112).

The container 100 includes a visual display assembly 120 for creating a multilayer or multidimensional display. The assembly 120 in this embodiment is formed of two separate labels that may be thought of as a mirror element 122 and a framing element 130, which are mounted, attached, or otherwise deposited, such as with adhesive to the rear and front portions 116, 114 of the sidewall 112, respectively, by heat shrinking of a label or labels containing the assembly 120, by tacking the mirror element 122 and applying a label or labels over the mirror element, or any other useful method for providing the assembly 120 and its components on or within a container or other object. The mirror element 122 includes a label substrate (such as a plastic such as, but not limited to, polyethylene terephthalate (PET), polyethylene (PE), polyvinyl chloride (PVC), oriented polypropylene (OPP), polyester PETG, other plastic, paper, or other material useful for labeling) with an exterior surface 124 and an interior or contact surface 126. The substrate of element 122 may be clear, translucent, opaque, or a variety of clarity levels to meet the needs of a particular applications. An optional text or graphic box 125 may be printed or attached to the outer surface 124, such as to provide product data, provide additional graphics, or the like.

Significantly, the mirror element 122 includes a reflective surface 128 that is formed of materials that function to reflect light that strikes it. In this regard, the reflective surface 128 may be formed integrally with the substrate of element 122 or may be attached in a separate operation or provided or formed as a separate element. In these latter cases, the reflective surface may be a thin metallic foil, another foil such as a metallized nylon, a metallized PET film, or similar foil that has reflective properties, a deposited coating, or any other single material or combination of materials that produce a reflective surface, which may in some cases even include coatings that provide a different index of refraction at the surface 128.

A primary or central image 129 is printed or otherwise positioned or provided on or proximate to the reflective surface 128 of the container 100. The image 129 in some embodiments is selected to be relatively elongated or tall (as measured along a longitudinal axis of the container 100) and to be relatively thin. This is because when the image 129 is viewed through the sidewall 112 (and front label or framing element 130) and any liquid (not shown) in the container 100, it appears wider. This can be thought of as "pre-distorting" the image 129 such that it appears with more expected or desired proportions when viewed. The image 129 may be a printed image as shown or, in some embodiments, the image 129 may be an image provided with electronic displays (such as liquid crystal displays, flat screens, or the like) and/or may be an "object." An object being understood to mean nearly any non-print or monitor/display image such as a 2D or 3D object mounted or provided on or proximate to the reflective surface 128. For instance, the object used for the primary image 129 may be a coin, a pressed flower, a butterfly or insect specimen, or nearly any other object, and in these embodiments, it may be useful for the surface 128 to be spaced off of the side wall 112 (or to not have one or more of the sidewall portions) and to provide an object with shallow (e.g., half) relief The container 100 may be empty (or only contain air) or it may be filled. If filled, the liquid, solid, or other material contained therein may be relatively opaque causing the image 129 to be only visible when the liquid is removed or the liquid may be transparent or translucent such as water, carbonated, alcoholic, or other beverages, or a consumer product such as shampoo, soap, bubble bath, perfume, mouthwash, toothpaste, hair gels, sanitizers, or the like. The invention is not limited to use with a particular liquid or content for the container 100, but it may be more effective in creating a desired image with particular clear, substantially transparent, or translucent liquids or solids (e.g., liquids or solids that allow a significant or only a small amount of light through and that are clear or tinted with color).

The visual display assembly 120 also includes a framing element 130 that may be provided with a separate label formed from a clear or translucent substrate, e.g., a thin layer of a clear plastic or similar material, that is attached with adhesive to the sidewall 112, e.g., the adhesive may be provided as a thin layer on the label or about the exterior/boundary of the element 130. As shown, the framing element 130 has an exterior surface 132 and an interior surface 140. The exterior surface 132 may be opaque or substantially opaque (such as by coloring it white or one or more other colors) and include one or more foreground images or patterns 134, with stars being shown i this example. The exterior surface or opaque frame on such surface 132 defines a viewing port or window 138 that is transparent or translucent, i.e., does not include the ink or printing that makes the frame portion opaque. Alternatively, framing element 120 may be formed from a single layer of translucent or semi-opaque material with window 138 formed as an opening through the material of framing element 120.

Figure 7:
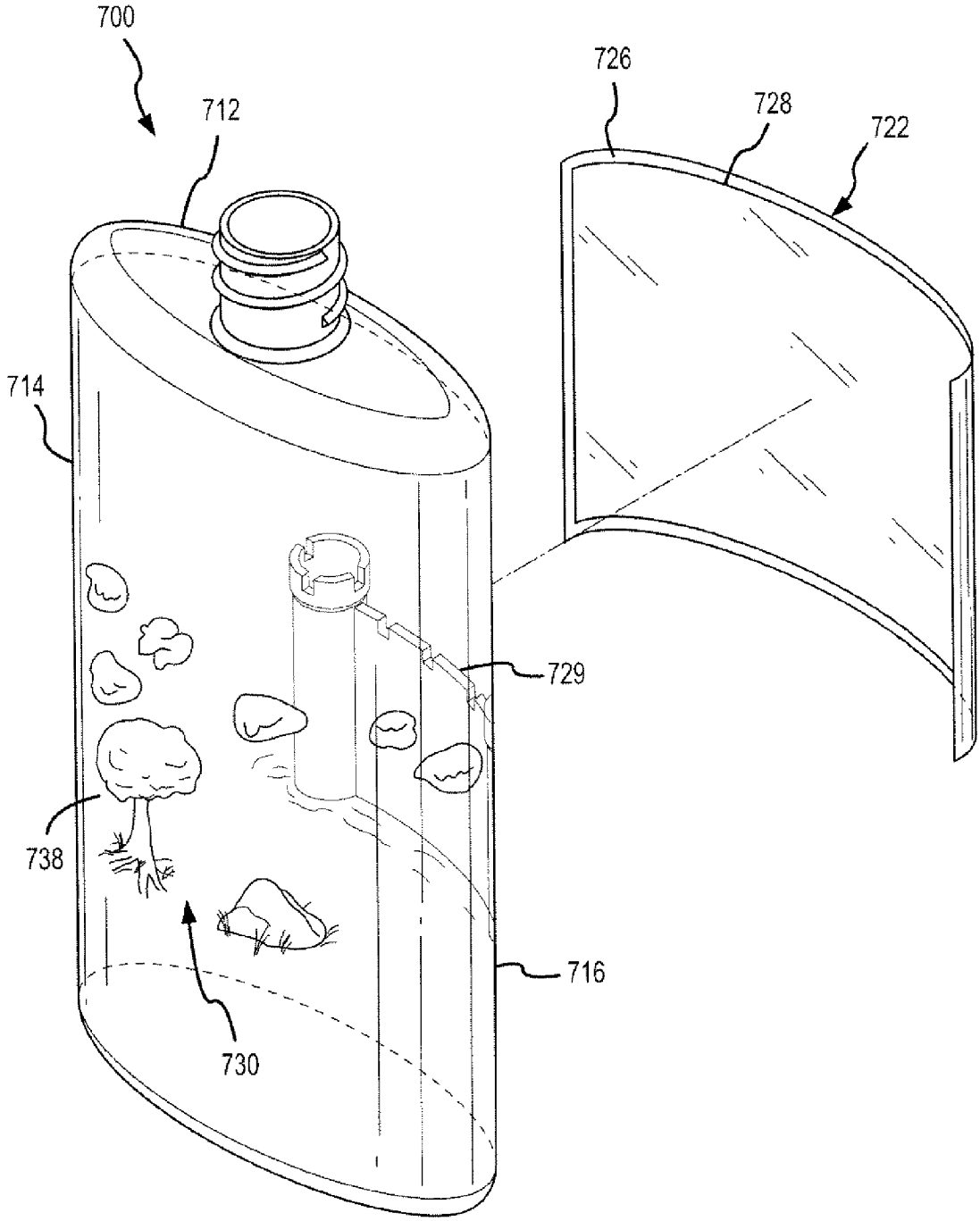
FIG. 7 is an exploded view similar to FIG. 1 of another embodiment of a container with a sidewall an oval cross sectional shape and with the framing element and the central or primary image being printed directly onto the container sidewall rather than being provided with a separate label, decal, or sticker.

The port or viewing window 138 guides or directs a viewer's line of sight through the framing element 130, through the container wall 112 (and any contents contained therein), and to the reflective surface 128 and the image 129. The shape of the port 138 is shown to be oval but in other embodiments the shape is circular, square, rectangular, triangular, or other shapes and in some cases, the port 138 may have an irregular shape (and may even include some foreground images 134) as shown in FIG. 7. The port 138 typically is selected to be the same size or smaller than the image 129 although this is not a requirement and is shown to have a shape similar to that of the image 129 but, again, this is not a limiting design parameter. Generally, the port 138 is selected to have a size and shape that minimizes or controls the amount of mirror or reflective surface 128 that is not "covered" by the foreground images 134 and/or frame 132 so as to enhance the achieved imagery or illusion (e.g., by reducing reflections of a viewer and other objects outside the container 100). Window 138 may be permanently opened or may be covered with a removable cover or flap (not shown) that allows a user to open or expose window 138 when desired.

On the interior surface 140 of the framing element 130, one or more background images 144 are provided. These images 144 may be printed or otherwise attached to the surface 140 or, in some cases, be provided as separate elements from the surface 140. The images 144 are positioned adjacent the port 138 and positioned so as to frame the image 129 when viewed on the reflective surface 128 through the port 138. The images 144 may be printed in mirror image arrangement so that they appear reversed or transposed (i.e., "correct") when viewed in the reflective surface 128 or are selected such that they appear correct or normal in the mirror. As shown, stars are used for the images 144 in part because they appear properly oriented when viewed directly or in a mirror or reflective surface. In other embodiments, surface 132 is not opaque and in these embodiments, the images 134 and 144 are typically visible directly as foreground images and through the reflective surface 128 as background images behind the central image 129.

The images 134 (and frame/surface 132), images 144, and image 129 may be provided as decals, stamps, or labels in a separate operation, but more typically, these images are printed onto the labels or elements 122, 130. The particular process used for applying the images 129, 134, 144 may be any of a number of printing techniques used in the labeling and packaging industries. For example, the images may be applied through flexographic printing as this type of printing is useful for applying thin uniform films of ink on plastic and other materials. Alternatively, rotogravure may be used to apply ink for the images to the elements 122, 130. In other cases, screen printing, web printing, pad transfer printing, letterpress printing, jet printing, or some other technique of printing may be used to practice the invention.

FIG. 3 illustrates a cross sectional view of the container 100. The view is shown out of true proportion with the ink/image layers and reflective surface shown with larger thicknesses to allow them to be seen in the cross section (e.g., the ink may be 0.005 or less in thickness in practice and the foil or other material used for reflective surface 128 may also be quite thin relative to the label or element substrates which may be several mils thick). As shown, the sidewall 112 defines a circular cross section with a radius, $R_C$, measured from the center of the void defined by the sidewall 112 or container to a point proximate to the positioning of the mirror element 122 and the framing element 130. The mirror element 122 is placed on rear portion of the container and generally takes the shape of the rear portion. In other words, the mirror element 122 is a semi-cylindrical shape when installed in or on the container 100, and as a result, the primary image 129 and reflective surface are arcuate or semi-circular in cross section as shown with a curvature defined by the container radius, $R_C$. For example, the radius, $R_C$, may vary in some embodiments from about 0.25 to about 6 inches (with larger sized containers also being considered a part of this disclosure). This semi-circular or arc cross section is useful for achieving the optical or display effects of the invention in some embodiments as the reflected background images 144 appear or are viewed as being behind the primary image 129 (which appears on the surface of rear portion 116 or slightly in front of the container wall 112 so as to "float" within the container interior space or volume). As shown, the viewed background images 144 shown in dashed lines are viewed or displayed at a distance, d, behind the primary image 129 due to the use of the reflective surface 128, positioning of the images on framing element 130 which is separated from the reflective surface 128 by about the diameter of the container sidewalls 112, and the distortions caused by the curvature of the reflective surface.

The width (or size) of the reflective surface 128 may vary to practice the invention. As shown, there may be a space or gap between the mirror element 122 and the framing element 130 (e.g., between the rear and front labels) but this is not required. In some embodiments, the reflective surface 128 extends significantly about the periphery of the sidewall 112 of the container, and may have a width that is ranges from about one fourth to about three fourths of the circumference of the container sidewall 112 with a width of about one third or less being used in some cases such that the reflective surface extends about 120 degrees or less about the container wall 112. As shown, the inner surface 126 is attached, such as with adhesive about the boundary of the reflective surface 128, to the rear portion 116 of the container sidewall 112, and this forces the reflective surface 128 and primary image 129 to be proximate to or to contact/abut the exterior surface of the rear portion 116 of the container sidewall 112. The substrate of element 122 then overlies the reflective surface 128 with its exterior surface 124 facing outward from the container sidewall 112 and the data element 125 is printed or otherwise provided on this surface 124.

The framing element 130 is mounted on the front portion 114 of the sidewall 112 such as by using adhesive to attach the inner surface 140 to the exterior surface of the sidewall 112. The framing element 130 is mounted relative to the mirror element 122 such that the viewing port or window 138 guides a viewer's line of sight through the viewing port 138, the container and its contents to the primary image 129 and reflective surface 128. This may be thought of as registering or aligning the port 138 as well as foreground and background images 134, 144 with the mirror element 122 and its reflective surface 128 and primary image 129. As shown, the inner surface 140 contacts or is proximate to the exterior surface of the container sidewall 112 at the front portion 114, which causes the background images 144 and port 138 to be proximate to or contact the exterior surface. The substrate of the framing element (or label) 130 is more distal to the container sidewall 112 with the exterior surface 132 and foreground images 134 typically being at least slightly spaced apart from the container sidewall 112 (e.g., by the thickness of the ink layer providing the background images and the thickness of the substrate of the framing element 130).

As shown with dashed lines, the lines of sight or vision for a viewer provided by the container 100 create a visual display. This display includes the foreground images 134 on the surface 132 of the framing element 130, the primary image 129 on or in front of the reflective surface 128 of mirror element 122 on the rear portion 116 of the container sidewall 112, and the background images 144 behind the primary image 129 (i.e., a distance, d, behind the image 129/reflective surface 128 as determined by the size of the container, the refractive index of the container contents and sidewall 112 at rear portion 116, amount of curvature of reflective surface 128, and/or other optical parameters or characteristics of the container 100 and the visual display assembly 120).

In some cases, it may be desirable to provide the visual display assembly in a single label. For example, this may be useful for more accurately registering or aligning the primary image, reflective surface, and the framing element with its viewing port and images. Also, many consumer products are presently packaged using wraparound labels that are applied by rolling on a bottle with adhesive, by heat shrinking, or the like, and in some embodiments, the visual display assembly is provided in such a wraparound or single piece label.

Figure 4:
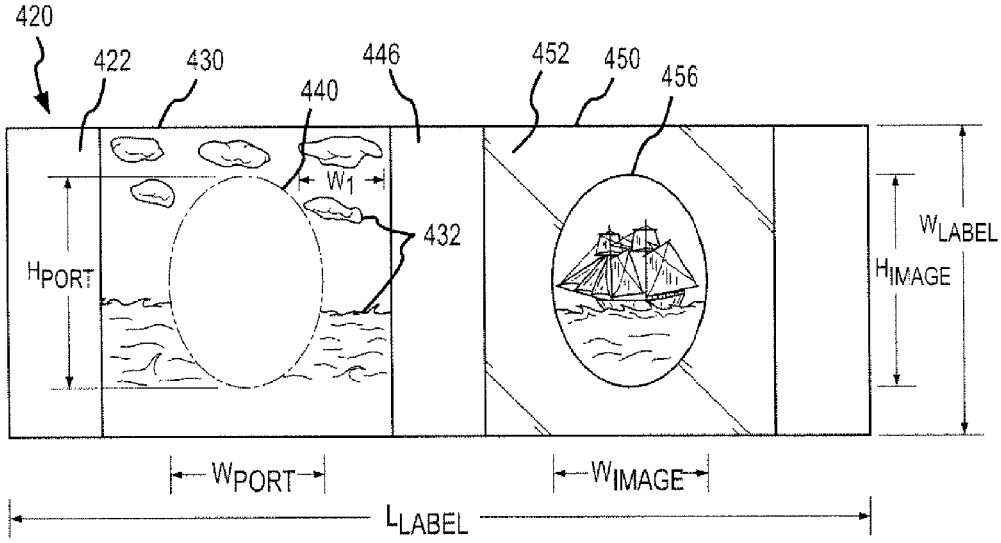
FIG. 4 illustrates an inner surface (i.e., the surface that contacts outer surfaces of a container sidewall) of a wrap-around label manufactured according to an embodiment of the present invention with a reflective surface and central image provided in a mirror element and background images and a view port or window provided in a framing element.

FIG. 4 illustrates a visual display assembly 420 of one embodiment of the invention that is provided on a wraparound label 422. The assembly 420 includes a framing element 430 that on the illustrated first or interior surface of the label 422 includes background images 432 (i.e., waves/water and clouds in this example) and a viewing port or window 440. As discussed with reference to FIGS. 1-3, the substrate of label 422 may be transparent or translucent and the port 440 may not be defined as shown with a regular boundary as shown but may instead be areas that are defined by areas in the framing element 430 which do not include background images 432 (and foreground images 433). Alternatively, the images 432 may create a scene or Fame that is opaque or relatively opaque to define the port 430 and this scene or its images are reflected by the corresponding mirror element when the label 422 is attached to a container. The images 432 may be printed onto the surface of label 422 (such as with flexographic or other printing methods) or as a decal, stamp, or the like that is attached using adhesives or other bonding techniques.

The assembly 420 further includes a mirror element 450 that on the interior surface of the label 422 includes a reflective surface 452 (e.g., a metallic foil, metallized nylon, metallized PET film, a reflective coating, or the like). The reflective surface 452 may be applied to the surface of the label 422 in a separate process or be attached to a label sheet having the framing element 430. A primary image 456 is provided on the reflective surface 452, such as in a central or substantially central position in the surface 452. For example, the image 456 may be printed on the surface 452 and/or attached as a decal or sticker. In other embodiments, the image 456 is printed on the exterior surface of the container wall 112 and the reflective surface 452 is then applied or attached to the surface of label 422 and includes a port, frame, or window through which the image 456 is exposed for viewing (in other words, the image 456 is not provided on the surface 452 in all embodiments but is surrounded by, adjacent, and/or proximate the surface 452 in some embodiments and may be printed or applied to the surface for ease of manufacturing and assembly of a container). In another example, a hole is cut or provided in the reflective surface 452 and the image 456 is positioned within this hole. Specifically, a printed image 456 may be provided on an inner or outer surface of a label 422 (or on or in the wall 112 of the container) and the "hole" in the reflective surface be provided to mate with the primary image, and in this manner, the image 456 may be more prominent when viewing as ambient light shines through the label 422 and, in some cases, image 456 to backlight the image 456.

A gap 446 may be provided between the framing element 430 and mirror element 450, such as to provide space for providing product information or the like, but this is not required and the elements 430, 450 may abut each other on the label 422. The mirror element 450 may be provided with nearly any shape, such as by die cutting. It may take a regular rectangular shape as shown in FIG. 4 or the boundaries may be irregular to suit a particular illusion and/or to integrate with surrounding portions of the label 422. The reflective surface 452 typically extends for only a portion of the length of the label, $L_{LABEL}$ so as to achieve a desired effect. For example, if the label 422 has a length, $L_{LABEL}$, selected to match a diameter of a container, it may be desirable for the width of the surface 452 to be less than about one half with some arrangements having a width of about one third of the label length, $L_{LABEL}$, or less so that the reflective surface extends about 120 degrees about a container circumference. It may be desirable to minimize the size of the mirror element 452 to control costs while still achieving a desired optical effect.

The primary image 456 has a height, $H_{image}$, and width, $W_{image}$, that may be selected to achieve a desired visual effect. For example, the height, $H_{image}$, may be selected to be at least equal to or significantly larger than the width, $W_{image}$, such that the image 456 is "tall" and thin as printed but will appear well proportioned or "normal" to a viewer after distortion effects causes by the curvature of the applied label 422 and the refractive index of container contents such as water, other beverages, or other liquids. Similarly, the background images 432 may have a printed width, $W_I$, that is selected to account for optical effects that may cause the reflected image to appear thinner, e.g., printed with a width, $W_I$, that is larger than a desired width of a reflected version of the image. The selected adjustments or changes in printed image dimensions are selected for an intended container size, sidewall material, and cross sectional shape as well as expected contents for such a container. For example, the central image 456 may be pre-distorted to be between 20 and 50 percent (such as about 30 percent) thinner than the width that is desired to be presented in the created display (i.e., as viewed by a viewer) as measured about an axis transverse or perpendicular to the longitudinal axis of the container 400. Similarly, the background images 432 may be made wider by similar amounts so that they appear at a desired thickness or width in the viewed display.

The port 440 also may be configured or defined to have a height, $H_{port}$, that is about the same as or less than the height, $H_{image}$, of the image 456 and to have a width, $W_{port}$, that is about the same as or less than the width, $W_{image}$, of the primary image 456. However, in some embodiments, the port 440 may be intentionally made smaller or larger than the image 456 to achieve a desired visual effect (e.g., to force a viewer to scope or view the image 456 through the port 440 with the container closer to their eyes or to provide a larger view of the reflective surface 452, respectively).

Figure 5:
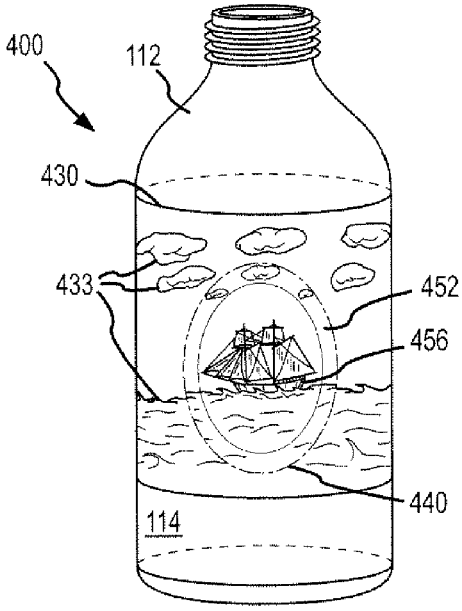
FIG. 5 illustrates a container with the label of FIG. 4 attached to generate a multidimensional display according to the invention including foreground images, a central or primary image, and background images.

FIG. 5 illustrates a container 400 with the label 422 attached with the inner surface shown in FIG. 4 applied to a container sidewall 112 so as to provide a visual display with multi-dimensions or layers with a wraparound label. The sidewall 112 may take the shape and circular cross section as shown in FIGS. 1-3, e.g., the container 400 may include a standard plastic, ceramic or glass beverage bottle or consumer product bottle or jar (e.g., the wraparound label 422 may be applied by heat shrinking or rolling onto a standard water bottle, a carbonated or health drink bottle, a beer, wine, or other alcoholic beverage bottle, or the like). In other embodiments, the wraparound label 422 may be applied to containers that do not have a circular cross section, such as containers with a polygonal cross section or have one or more relatively flat surfaces (such as currently produced sport or health drink bottles), shampoo, soap, and other consumer products with oval or elliptical cross sections, and other non-circular cross section containers. When the mirror element 450 is curved to some extent it is possible to achieve more dramatic visual effects (e.g., see FIG. 6) but this is not required to practice the invention.

When the label 422 is applied to the container sidewall 112, the framing element 430 allows a viewer observing the container 400 to see a visual display that includes the foreground images 433 in the framing element 430 on the front portion 114. Also, through the port or window 440, the viewer sees the primary image 456 which appears to be "floating" in part because the background images 432 are seen via reflection from the reflective surface 452 to be behind the primary image 456 due to their positioning on the inward facing surface of label 422 or framing element 430. While not required, it is often desirable to select an adequate quantity of background images 432 relative to the primary image 456 to provide a desirable ratio of these images to enhance the floating or multi-dimensional effect or illusion. Again, it is typically desirable to select images 432 that are either printed in mirror image on the label 422 or that appear properly oriented when viewed in the reflective surface 452 (such as symmetric graphics or text/symbols (e.g., A, O, I, W, and the like)). In some embodiments, the foreground images 433 are not additional images printed on a second or exterior facing surface of the framing element 430 or label 422 but instead are simply the backside of background images 432 printed or provided on the inward or interior surface of the framing element 430. In these embodiments, it is even more desirable to select images that appear correctly oriented when viewed from either side, such as symmetric images such as stars, clouds, waves, or the like that also make contextual sense or provide a eye-pleasing display as foreground images 433. In this case, the foreground images 433 would be viewed through the label substrate 422 which is selected to be transparent or at least translucent. The length, $L_{label}$, is typically selected to be at least about the circumference of the sidewall 112 and sometimes slightly larger to obtain an overlap of used in binding the label 422 to the container sidewall 112.

As discussed throughout this description, the visual display assembly and packaging concepts of the invention are useful with a wide variety of container materials and shapes. The containers may be filled with clear or translucent liquids, gels, solids, or gases to allow viewing when the containers are filled or may be used with opaque liquids, gels, or solids and provide display when the contents are at least partially moved or removed. With these many varying embodiments in mind, FIGS. 6 and 7 illustrate additional embodiments of the invention.

Figure 6:
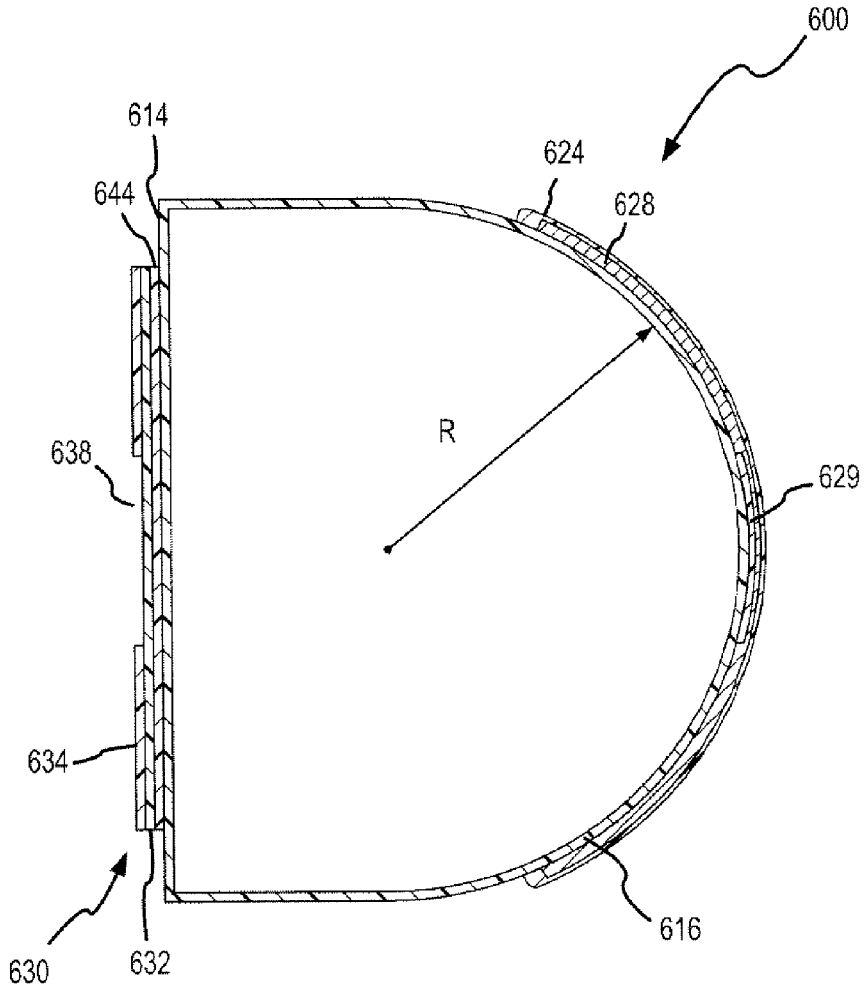
FIG. 6 is a sectional view similar to FIG. 3 of another container of the invention with two labels being used to provide a visual display assembly on a bottle with a "D" cross section.

The container 600 of FIG. 6 is shown to include a sidewall (e.g., clear plastic, ceramic or glass) 612 with a non-circular cross section. Specifically, this exemplary embodiment 600 provides a first or front wall or portion 614 that is flat (or only slightly curved) and a second or rear wall or portion 616 that is a semi-cylinder with a semi-circular or arc cross section (or parabolic, elliptical, or the like in other embodiments not shown), i.e., the container 600 has a "D" cross sectional shape. In this container 600, a mirror element 622 is attached to the curved rear portion 616 of the sidewall 612 to also take on a curved or arced cross sectional shape that has a curvature defined by the radius, R, of sidewall 612 at the rear portion 616. The mirror element 622 includes a substrate that may be opaque or transparent with an outer surface 624 distal from the sidewall 612, which may optionally include text or graphics visible from the outside of the container 600. A reflective surface 628 is provided on the inner surface of the mirror element 622 substrate, and may cover all or a portion of the substrate 628. A primary image 629 is provided on or adjacent the surface 628 (e.g., to be surrounded by the reflective surface 628) and may be printed or attached directly to the reflective surface 628 or to the rear portion 616.

A framing element 630 is mounted or provided on the flat, front portion 614 of sidewall 612. The framing element 630 may be similar to element 130 of FIG. 1 with background images 644 that are provided adjacent to the exterior surface of the front portion 614. The label or framing element 630 includes a transparent or translucent layer or substrate 632 in which a viewing window or port 638 is provided, e.g., with its shape and size defined by the positioning, size, and shape of the background images 644 and foreground images 634. The foreground images 634 may be separate components as shown (e.g., a layer of ink, a decal, or the like) or may be viewed versions of one side of the background images 644. In use, the container 600 directs a viewer's line of sight to the foreground images 634 and through the port 638 to the reflective surface 628 where the background images 644 are visible adjacent to and behind the primary or central image 629.

FIG. 7 illustrates a container 700 that may be useful for many consumer products that use non-cylindrical containers such as bubble bath, soaps, shampoos, and the like. The sidewall 712 is shown to include a front portion 714 and rear portion (or front and rear/back walls) that have an oval, elliptical, or other non-circular cross section. A mirror element 722 is attached, such as with adhesive, to the rear portion 716 and takes on the curved shape of the rear portion 716. This shape may be thought of as a portion of an ellipse or as an arc taken from a relatively large circle, and this shape results in a small amount or degree of curvature when compared with containers 100, 400, and 600 for the mirror element 722. In some cases, the mirror element 722 may be planar or only slightly curved or substantially planar to practice the invention. The mirror element 722 includes a reflective surface 728 on an interior surface 726, and this reflective surface 728 is positioned proximate to or in abutting contact with the exterior surface of rear portion 716 of sidewall 712 so as to face inward into the container 700. A primary or central image may be provided on or near the reflective surface 728 as shown with other embodiments.

Container 700 illustrates that one or more of the images may be printed directly on the exterior surfaces of the container sidewall 712 (or otherwise applied such as by separate labels, stickers, stamps, or decals). As shown, the primary image 729 (e.g., a castle or building in this example) is printed or otherwise attached directly to the exterior surface of the sidewall 712 in the rear portion 716 and is covered by the mirror element 722 such that the reflective surface 728 surrounds or is adjacent to one or more sides of the image 279. Similarly, the framing element 730 in this container 700 is printed or provided directly on an exterior surface of the front portion 714 of clear sidewall 712. The framing element 730 is shown to include one or more images 744, which provide both the foreground images and the background images as they are visible both from the exterior of the container 700 and via the reflective surface 728 through the container 700. In some embodiments, the framing element 730 does not include any printed images by is instead an image, scene, pattern, text, texture (e.g., with or without details or images but simply providing an image obscuring film defining a viewing port or window that may be provided or defined by providing a non-image obscuring and/or clear viewing area within the textured surface) or any combination thereof that can be provided in numerous ways such as by texturing a surface (e.g., frosted, sandblasted, or otherwise processed glass, plastic, or the like), providing molded contours, and the like. For example, the framing element 730 may be provided with a wall or surround created with an image obscuring film such as an opaque or a translucent film that includes a non-image obscuring portion to provide a view port or window (such as with a clear or substantially transparent area(s) within the translucent or the opaque areas). More specifically, the reflective surface 728 that reflects the inward facing side of images 744 and the primary image 729 are visible through a viewing window or port 738 that is defined by the arrangement of the images 744 in the framing element 730. In other words, the port 738 is a clear or translucent area of the framing element 730 that does not include the images 744 and a viewer is able to see through the port 738 portion of sidewall 712 by looking through the pattern created between the images 744. Alternatively, port 738 may be formed by a cut-out portion that exposes portions of the outer surface of sidewall 712. In other embodiments, some or all of the images 744 may be provided on a clear or partially clear label, decal, stamp, or the like.

Although the invention has been described and illustrated with a certain degree of particularity, it is understood that the present disclosure has been made only by way of example, and that numerous changes in the combination and arrangement of parts can be resorted to by those skilled in the art without departing from the spirit and scope of the invention, as hereinafter claimed. For example, the visual display assemblies shown and described above includes a single reflective surface with a single primary image and a single viewing window, but other embodiments may include more than one viewing window to direct a viewer's line of sight to one or more primary images provided on or proximate to one or more reflective surfaces. The images and reflective surface (s) may be provided on a smooth exterior surface of the container that is typically curved outward from the container (i.e., convex) but some embodiments may utilize mounting surfaces that curve inward toward the container (i.e., concave), with adjustments to pre-distortions made to the printed images. Further, double convex bar shaped lenses such as that provided by a cylindrical bottle/container or object magnify an image, such as the primary image, in the horizontal dimension whereas double concave and planar concave bar shaped lenses of other embodiments shrink an image in the horizontal dimension. A planar mirror or reflective surface may work well in some instances of the invention. For example, if a container was provided with a flat back with a mirror on it and a view port on a front surface or sidewall (opposite the flat back wall) which is concave (e.g., round or bar shaped), the view port reflection would be distorted so a viewer would not recognize images outside the container even with a flat mirror. Hence, it is important to account for both view port reflected surface distortion as well as curved mirror distortion.

The illustrated embodiments generally show one or two labels being applied to a container so as to provide the visual display assembly. However, it will be readily understood by those skilled in the packaging and printing industries that the visual display assembly or portions thereof may be provided by other methods such as printing directly on a container sidewall or by deposition techniques. For example, the background images and primary images may be printed or deposited on the interior or exterior surfaces of the sidewalls followed by applying or attaching a reflective surface or layer over the primary image and a framing element with a viewing port over the background images. Alternatively, the framing element may be provided by deposition while the primary image and mirror element are provided by labeling techniques or any combination of such printing, deposition, or labeling methods may used to form containers or objects of the present invention.

Also, certain embodiments of the invention provide one or more of the components of the visual display assembly within the container sidewalls such as on an interior surface, as an integral part of such sidewalls (such as by providing 3D contouring of the interior and/or exterior surfaces of the sidewall), within the a multi-layer or multi-component sidewall (e.g., the background image, the primary image, and/or the reflective surface or other components may be sandwiched or otherwise provided between two layers (e.g., an inner and outer layer) of multi-part sidewall), or even within the void defined by the sidewalls.

Figure 8:
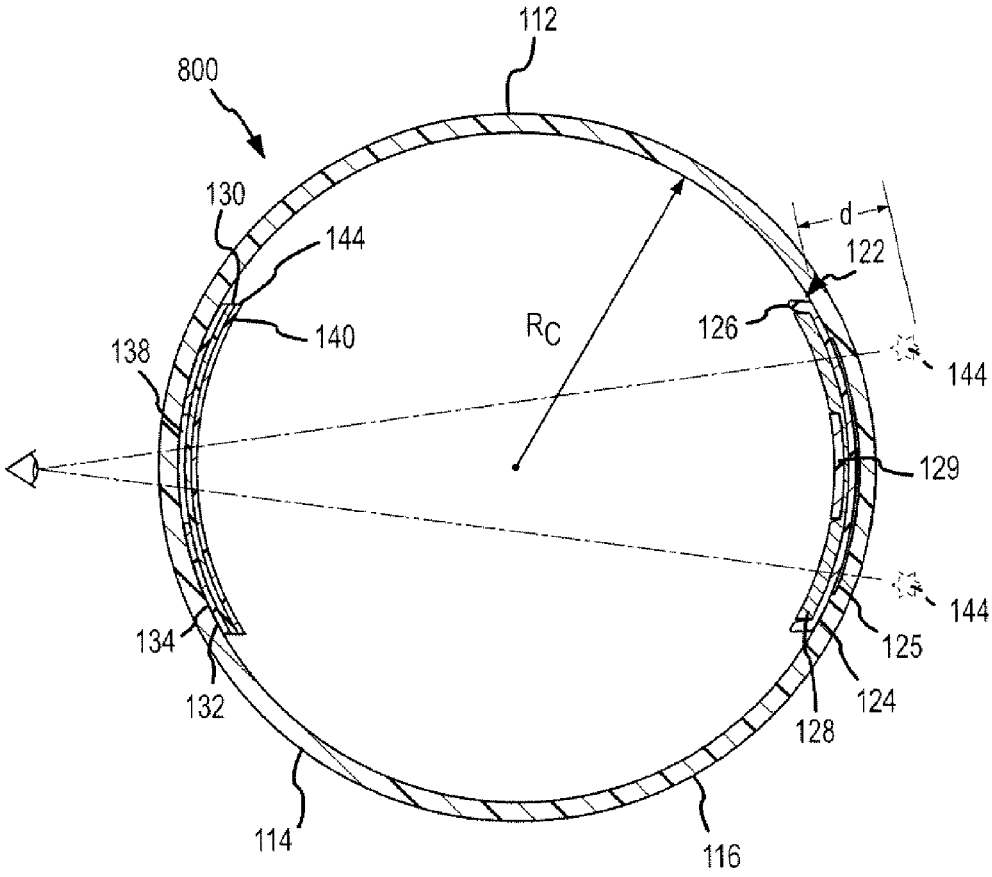
FIG. 8 is a sectional view similar to FIG. 3 of another container of the invention such as a bottle, cup, glass, jar, or the like in which the visual display assembly is positioned on the interior surfaces of the container sidewall.

FIG. 8 illustrates a container 800 of the present invention, which may be provided in the form of a bottle, ajar, a glass, a cup, or other containers but is shown using the sidewall 112 similar to that shown in FIGS. 1-3 for ease of illustration. The sidewall 112 is shown to have a cylindrical cross section with a radius, $R_C$, but it should be understood that the sidewall 112 may be sloped (i.e., a smaller radius one end) and/or be of a differing shape such as oval, square, rectangular, or the like. As shown, the visual display assembly is positioned within the container's void space on the interior surfaces of the front portion of the sidewall 114 and the rear portion of the sidewall 116, which may be useful particularly in open ended containers such as cups or glasses. The framing element 130 and mirror element 122 are shown to be provided as separate components or assemblies such as may be the case of a two part label, decal, or the like. Alternatively, the mirror element 122 and framing element 130 may be provided in a single label that extends partially or fully about the interior of the sidewall 112. In other embodiments, the framing element 130 or the mirror element 122 (or one or more of their parts such as the primary image 129, the background images 144, the reflective layer or surface 128, or the like) are provided on the interior surface of the sidewall 112 as shown in FIG. 8 while the other is provided on the exterior surface of the sidewall 112 as shown in FIGS. 13.

Figure 9:
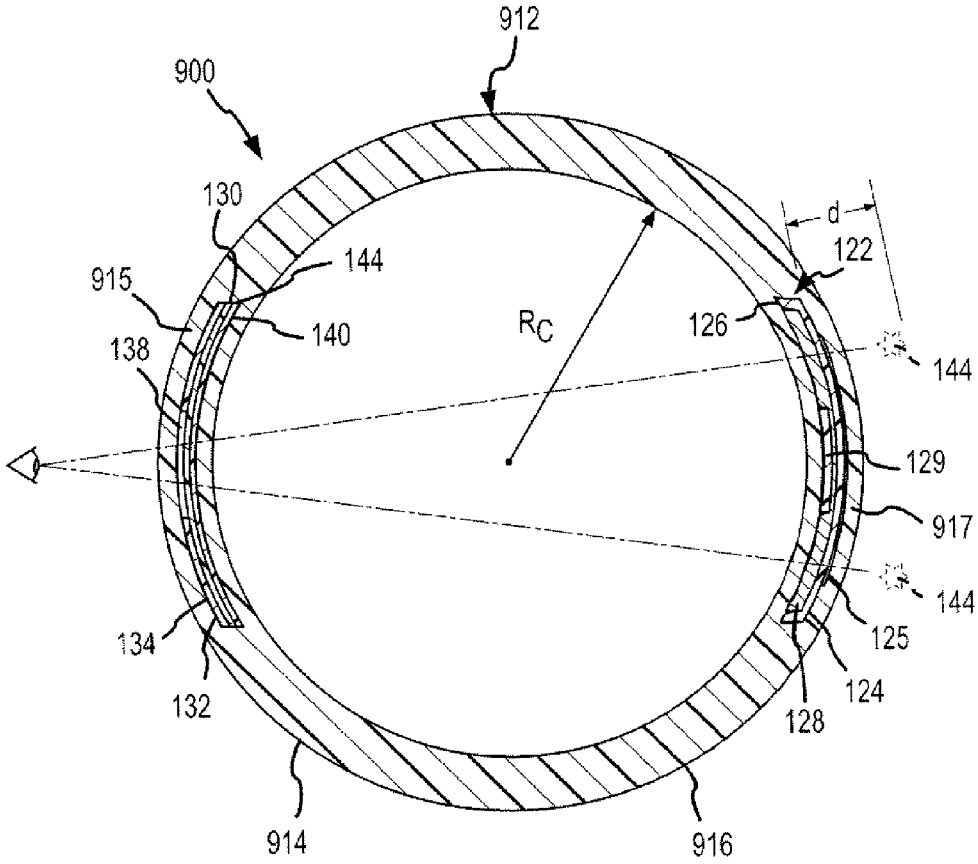
FIG. 9 is a sectional view similar to FIGS. 3 and 8 of another container of the invention such as a bottle, jar, glass, cup, or the like in which the visual display assembly is provided within or as a part of the sidewall of the container.

FIG. 9 illustrates yet another embodiment of a container 900 of the invention. The sectional view is similar to that of containers 100 and 800 of FIGS. 3 and 8 and the container 900 may comprise a bottle, a jar, or other "enclosed" container or an open ended container such as a glass or cup. The sidewall 912 differs from sidewall 112 of the other embodiments as it is configured to receive, hold, or sandwich the visual display assembly 120 or portions thereof between two components of the sidewall 912. In some cases, this may be achieved by providing a sidewall with a pocket or hollow space between an inner and outer shell, with the pocket extending entirely about the sidewall or circumference of the container. In such an embodiment, the visual display assembly may be provided as a single part such as a single label or "card" or may be provided as two or more parts such as two cards or labels that are inserted into the pocket or hollow space in the wall. Again, portions of the visual display assembly, such as the primary image 129, the background images 144, the foreground images 134, and the reflective surface may be provided separately on the interior surface of sidewall 912, the exterior surface of sidewall 912, or within the sidewall 912 as shown.

As shown, the container 900 has a sidewall 912 with a front portion 914 in which the framing element 130 is provided or positioned. The sidewall 912 also includes a rear portion 916 in which the mirror element 122 is provided or positioned. More specifically, the sidewall 912 includes a pocket or hollow space formed by the front portion 914 of the sidewall 912 and a front pocket wall 915 that extends from the front portion 914 (e.g., the sidewall 912 may have a two part construction defining a pocket for receiving the framing element 130 in the front portion 914). Similarly, the sidewall 912 includes a second pocket or hollow space formed by the rear portion 916 of the sidewall 912 and a rear pocket wall 917 that extends from the rear portion 916. The pocket walls 915, 917 may be selected to have a width of about the width of the framing element 130 and mirror element 122 as shown or be larger. Further, the pocket walls 915, 917 may extend the height of the container sidewall 912 or may be only have a length as measured along the axis of the container 900 that is about the same as the framing element 130 or mirror element 122. In some cases, the pocket formed by the pocket walls 915, 917 is relatively thin (such as forming a pocket similar to a shirt pocket) or may extend outward to form a bubble or partial sphere (or other shape) on the exterior surface of the container wall 912. As discussed above, the sidewall 912 is typically translucent or transparent where the mirror element 122 (or at least the reflective surface 128) and framing element 130 (or at least the viewing port 138) are provided. Likewise, the pocket walls 915, 917 are generally are formed of transparent or translucent material or include a portion that is translucent or substantially transparent, e.g., to provide a line of sight through the viewing port 138 to the reflective surface 128 and primary image 129.

In some embodiments, the foreground, background, and/or primary images may be provided in a manner that allows them to be changed. For example, a container may be configured such that one or more of these images is a decal, sticker, or the like that can be removed and replaced with a differing decal, sticker, or the like with a different image (e.g., allow a user to replace a primary image with a photograph of themselves to place them in the display). These embodiments may include having the primary image being provided on a sticker or decal (or separate label) that can be "plugged" in or inserted into a space in the reflective surface (such as by leaving a hole or gap in the substrate upon which the reflective surface is mounted or provided). Alternatively, the images may be adapted for alteration such as by coloring, painting, or the like or may be later provided by a consumer, e.g., by providing a space or canvas area upon which the images may be placed. In some cases, the images may be provided using electronics rather than printing such that they may be changed (e.g., by changing a screen provided on the reflective surface or in the framing element to show differing images from memory).

The invention provides an optical illusion assembly (or visual display assembly) that may take the form of a label or labels, decals, and other packaging and a lens system that may take the form of a container as discussed above or take other forms as described below (e.g., solid transparent objects or the like). The optical illusion assembly includes a primary image provided on or near a mirror element with a reflective surface. The reflective surface is typically at least slightly or partially curved (at least on one axis) or is non-planar. Often, this is achieved by providing the reflective surface on a conformable mirror element (e.g., a metallic layer, metallized plastic, or the like) on or attached to a thin, flexible plastic layer such as is found in wraparound labels attached to plastic containers. The reflective surface may, in these cases, be applied to a container or other object so as to take on the curve or shape of the outer surfaces of the container or object walls. In contrast, prior devices using mirrors generally used rigid, planar mirrors (e.g., mirrors set at 45 degrees from a front exterior surface) and often only achieved their effects by placing three dimensional objects within the container or lens portion (such as in cubes with mirrors). The curved mirror of embodiments of the present invention provides significant improvements by better disguising or hiding that a viewer is looking at a mirror.

The optical illusion assembly and lens system of the invention achieve several desirable results. The reflective surface with the proximate printed image and distal foreground images along with the optical characteristics of the lens system create the illusion that the printed image appears in front of the reflective surface such as inside a container or other object. However, the configuration described above (such as with reference to FIGS. 1-7) also creates an illusion that is primarily viewable through the viewing port or portions of the container or object opposite the reflective surface. Hence, when a viewer chooses a viewing angle or line of sight not through the viewing port or frame about such a port, the viewer typically cannot see the primary image or at least the image does not appear to be projected within the container or object. This "disappearing" or erasing image furthers the illusion achieved by the present invention. For example, if the container 100 of FIG. 1 is viewed from the top or bottom (e.g., upward or downward into the bottle), the image 129 is not visible within the container walls 112 while the image 129 is clearly visible through port 138 and appears to be within the container walls 112. Generally, the viewer can see the primary image or object 129 from many angles (through walls or surfaces with a clear view to the object) as long as the wall or surface is generally parallel to the image, but the viewer cannot see the image 129 when they look through an off angle or perpendicular wall. Yet further, the invention provides a self-animating illusion in that as the container or object is moved or the viewer moves so as to change the line of sight or viewing angle through the viewing port the primary image being projected also appears to move or is animated. This illusion is achieved in some embodiments due to the combined use of a curved reflective surface and cylindrical lens (e.g., container walls and contents). In these embodiments, the change in viewing angle results in the primary image moving relative to the foreground images and the reflected background images. This self-animation effect improves the illusion by better detaching the primary image from the surface of the mirror and from the foreground images and reflected background images. In many cases, the sidewalls of the container or body of the object on or in which the visual display assembly is provided will be substantially transparent or translucent light to allow a viewer to see through the sidewalls and the interior of the container (which may be filled with liquid or solid that adds to the optical effect by providing more lens material or that is colored or opaque). However, it may be desirable to only provide a portion of such sidewalls that are transparent or translucent. For example, the sidewall may be translucent where the mirror element or only its reflective surface is positioned and where the framing element or only its viewing port or window is positioned or provided, and some or all of the rest of the sidewall or object body may be less transparent to opaque.

The above description describes in detail the use of the inventive concepts of a visual display assembly that includes a reflective surface (e.g., a curved or nonplanar mirror) with a proximate primary image, foreground and/or background images and a lens or optical system to achieve desirable optical imagery in containers. However, these inventive concepts can readily be expanded to non-standard "containers" and many other objects and products. For example, the containers in FIGS. 1-7 are shown to have smooth or relatively smooth sidewalls. In some embodiments, the sidewall opposite the reflective surface (e.g., front sidewall 114 in FIG. 1 or the like) is textured to create the viewing port and to create the foreground and background images. For example, one or more smooth areas may be provided on the front sidewall to provide one or more viewing ports or windows and shapes may be provided as raised or recessed surfaces in the sidewall. These textured shapes or surfaces are then seen in the foreground as images and also reflected from the reflective surface (e.g., mountains, stars, clouds, or nearly any other shape/design such as a cave or other design). These textured surfaces or shapes about the viewing port/window(s) may be provided in the sidewall during fabrication of the container (such by providing a particular mold for use in blow molding or the like) or later attached in a separate operation (e.g., a plastic label with a three dimensional surface may be attached to a container sidewall). Again, the images described herein may be provided by deposition techniques and by techniques that add or remove materials from surfaces (such as the interior or exterior surfaces of label substrates or sidewalls of containers or surfaces of objects).

In another example, visual display assembly may be provided as a more rigid package assembly rather than as with a thin flexible label or labels. This may involve providing a single piece or package assembly that is formed of plastic, ceramic, glass, or other material (or includes such transparent or translucent materials at least in the viewing port portion). The package assembly may have a cylindrical, oval, clam shell, or other cross section. The sidewalls are typically relatively rigid, such as 15 to 20 thousandths or more of plastic, ceramic, glass, or other material. This package assembly includes the framing element with the view port, foreground images, and background images and also the reflective surface and primary image (which may also be provided on or in the package contents). The sidewalls of this package assembly may provide the lens for the assembly and contents may be placed within the package assembly. In other cases, a lens element is inserted inside the container sidewalls with the sidewalls acting as a sleeve that fits over the lens element or as a shell (e.g., two halves of a clam shell or the like) that are closed on or wrapped about a lens element. The lens element may be a bottle or container as described in FIGS. 1-7 or take on other forms, such as a solid object such as a rod or cylinder formed of plastic, ceramic, glass, or the like. The sidewalls of the package assembly may configured to mate tightly or closely with the sidewalls or, in some cases, a space is left between one or both of the front and back sidewalls so as to achieve a differing visual effect (e.g., to achieve a 3D effect).

In yet another embodiment, the container of FIGS. 1-7 is replaced with a solid object (e.g., a block, a rod, or the like). For example, a label or labels providing the visual display assembly with its framing element and mirror element may be applied to a cylinder formed of a clear or translucent material such as a glass, ceramic or plastic (e.g., acrylic or the like) rod. The use of the a cylindrical object in place of the containers of FIG. 1-7 achieves similar or, in some cases, improved visual effects/results because the optical characteristics of the solid object are more readily understood and selected to achieve a desired effect when compared with a liquid provided in a container.

Because the number and variety of products that may incorporate the present invention are numerous it may be useful to list a representative group of products that are considered to be covered within the breadth of the above description and language of various ones of the following claims. A "container" is intended to be relatively broad term and include nearly any object with walls having exterior surfaces and may include objects that are solid with the container walls defining the shape and size of the object. For example, the container may be a simple bottle, glass, cup, jar, or the like or be a different container and may take standard or conventional shapes and dimensions or vary significantly with round/spherical outer dimensions or be an object that includes a circular, cylindrical, or other shaped portion for holding a liquid, solid, or other substance. The visual display assembly is then typically applied or provided on the exterior surfaces of such an object. In other cases, the visual display assembly may be provided as part of one of these wails or even be provided on interior surfaces. Products that may utilize the container and visual display assemblies of the invention include, but are not limited to, bubble bath, shampoo, and other consumer product bottles or containers, baby bottles, aquariums, sport bottles, pens, perfume containers, windshield fluids, translucent oil containers, toys with cylindrical or non-planar surfaces such as teething devices, rattles, and the like, beach balls, floatation devices, and other inflatable toys and objects, syringes, intravenous pouch, glue tubes/packages, globes (e.g., snow globes that may include 3D objects in the container and floating objects such as glitter in the contained liquid), home/business water bottles and purifiers, consumer water bottles, cups, and carbonated beverage containers. Again, the liquid, solid, or other substance within the container may be selected for its optic qualities including a desired index of refraction and other qualities (such as water, vodka, shampoo, or the like) to achieve an enhanced optical result (e.g., provide additional lens or lens element/assembly thickness).

When it is understood that the inventive concepts described herein are applicable to non-standard containers and objects that may be solid, the listing of products and apparatus that may incorporate a visual display assembly of the invention can be expanded even further. The following is a non-exclusive listing of other products that may incorporate a visual display assembly: ornaments, devices with LED or other sources of light for lighting the interior of the "container," an alarm clock, floating/animated time face devices, floating plasma-type TVs and electronics, lamps, comic books, jewelry, key chains, and the like.

Further, these non-standard container embodiments and the container embodiments (such as those shown in FIGS. 1-7) may be adapted to achieve additional effects or to have additional features. For example, light sources such as LEDs or the like may be provided on or within the container or assembly to light the container contents or to light one or more of the images so as to achieve a desired effect (e.g., to selectively illuminate portions of the image with the light source). Other supplementary lighting such as conventional table lamps, flashlights, or lighted display stands/cases may be used to increase the quantity or quality of available light. The use of supplementary lighting increases the quantity of light available to produce the illusion and may improve the quality of the illusion, compensate for lower reflectivity films, and/or allow for darker images or designs whose performance would be limited by relying on ambient lighting alone. Supplementary lighting may be modulated to provide colors and/or polarization or other qualities that are not readily controlled with ambient light alone and, therefore, enable a wider variety of visual effects.

The visual display element or portions of such a display element may be replaceable to allow one or more of the images to be changed. Alternatively, the visual display assembly or portions of it may be moveable (e.g., the assembly may be provided on a label or sleeve that can be rotated about the periphery of the container or moved/slid up and down on the container/object), which may be used to change the images being displayed (e.g., change the foreground and background images and/or change the primary image). The visual display assembly may include multiple viewing ports and/or reflective surfaces so as to provide multiple panels for showing differing images and/or for telling a story. In some embodiments, the container sidewall, the label material, the image ink, and/or the container contents may be temperature sensitive so as to change with varying temperatures (e.g., show a different character, changed character, different/changed background and/or foreground images, and the like in different temperature ranges). The images used in the visual display assembly may be printed with ink to allow them to be seen in the dark (i.e., glow in the dark effects) or under a black light. The images typically are shown to be proximate to the reflective surface and may be removable, replaceable, and/or changeable (e.g., through electronic displays or the like) and in some cases the primary image may move (e.g., through an electronic display, by providing the image in a liquid (in a reservoir near the reflective surface or in the void space defined by the container sidewalls) or on a swivel to rotate with the movement of the container, or the like). The image may be a projected or projection image and may have other desired qualities such as luminous, light sensitive, temperature sensitive, or the like.

The images used in particular implementations may be aesthetic, entertaining, and/or informational. For example, the images may contain a barcode that implements a game piece, coupon, or UPC code that is secure because it is formed facing toward the inside of a container. A security image (e.g., a barcode) may comprise portions of the primary image, foreground image, and/or background image all of which must be present in a composite image. This not only inhibits tampering with the security image itself but also can provide some confirmation of product/container integrity as the composite image can be made to be very sensitive to container damage or changes in the contents. The images can be used to display product information such as ingredients, nutritional information, directions for use, and the like. The images can be contextually tied to the product (e.g., floating lemons in a lemon flavored beverage) or contextually unrelated to the product (e.g., cartoon characters or film promotional images inside a cup).

In some cases, it may be desirable to provide a visual effect when a container or object is viewed from above or below. The embodiments shown in FIGS. 1-9 generally show the viewing port or window being directly opposite of the primary image (e.g., the center of the viewing port and the center of the primary image and/or reflective surface may be on a single horizontal plane passing through the container or object). However, "opposite" positioning of the viewing port and the primary image or reflective surface is intended to be construed more broadly so as to include nearly any spaced apart positioning of the viewing port and the primary image and reflective surface. For example, in the container embodiments, any positioning of the framing element on a surface or wall on the other side of the container from the primary image or reflective surface would be considered to be an opposite positioning. Generally, the framing element and the mirror element are positioned spaced apart with all or portions thereof provided in parallel planes (such as 180 degree spacing on a cylindrical container wall or the like). To achieve viewing of the primary image from a line of sight above or below (or at a significant viewing angle) the horizon (e.g., the container not being held or positioned substantially at eye level), it is useful to provide the viewing port in a different position in the framing element.

Figure 10:
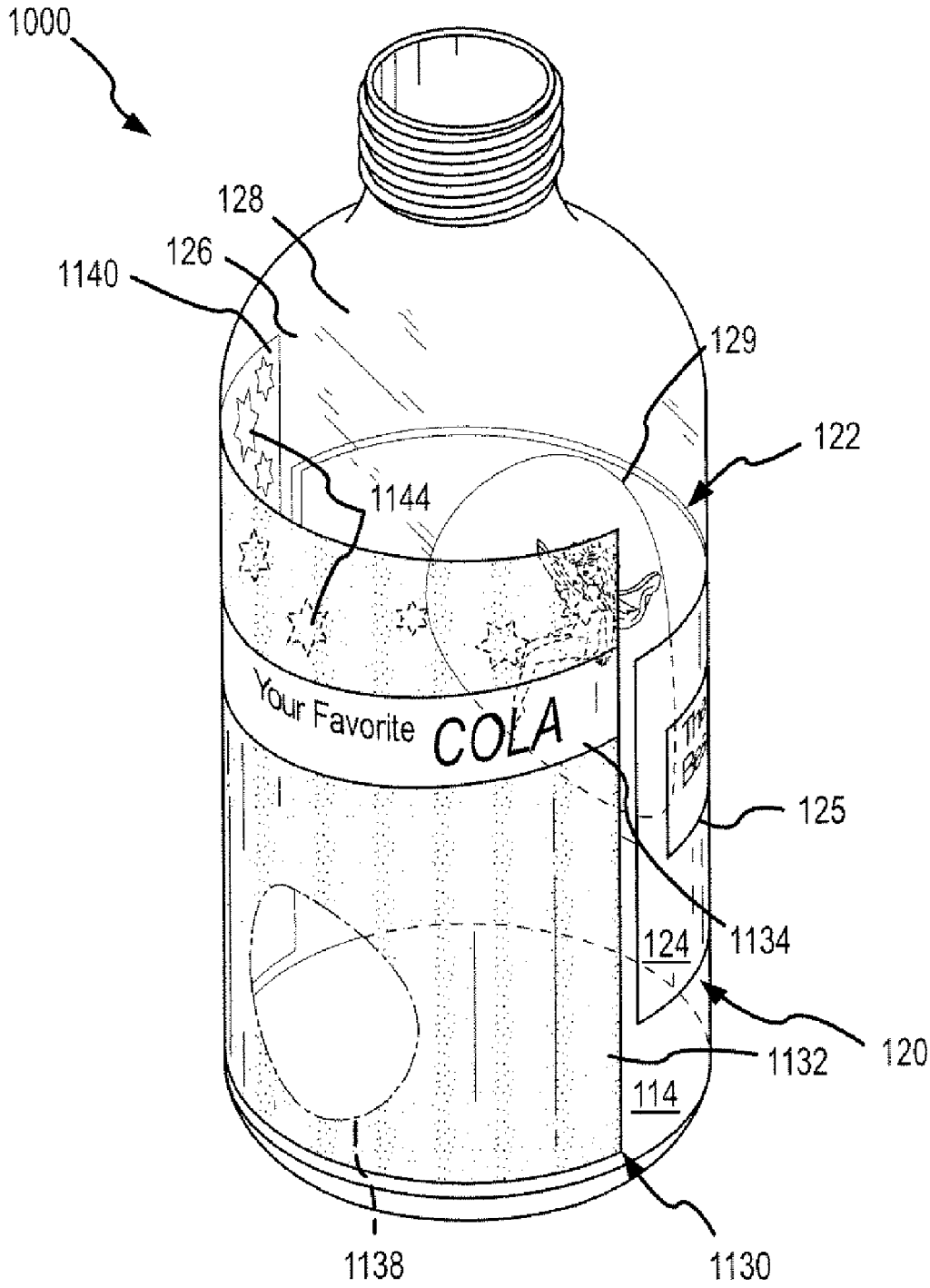
FIG. 10 is a perspective view similar to FIG. 2 of another container according to the invention in which the framing element is adapted to provide a view angle upward into the container (rather than having the viewing port more directly opposite the primary image and reflective surface).

FIG. 10 illustrates a container 1000 that is adapted for providing a visual effect when the container is viewed from below eye level (or below the horizon). As shown, the container 1000 includes a mirror element 120 attached to a rear portion of the container's sidewall as shown for the container of FIG. 2. In contrast to the container of FIG. 2, though, the container 1000 includes a framing element 1130 that includes a viewing port or window 1138 that is positioned lower upon the front portion or front sidewall 114 of the container 1000 relative to the primary image 129 in the mirror element 120. For example, the center of the port 1138 may be a fraction of an inch to several inches or more lower than center of the primary image 129 such that a viewing angle ranges from several degrees to a much larger angle such as 30 to 60 degrees or more (with such a viewing angle typically being measured from a horizontal plane passing through the primary image 129 to the viewing port 1130 or a central point of the port 1130 (e.g., the line of sight provided by the viewing port and the horizontal plane bisecting the container 1000 and image 129)).

The framing element 1130 includes a translucent or opaque outer surface 1132 that defines the size and shape of port 1138, which is non-image obscuring and is typically clear or substantially transparent. The surface 1132 is an image obscuring area and may include foreground images such as image 134 shown in FIG. 2 or may be frosted or otherwise textured (such as with raised or depressed surfaces) with or without patterns. The framing element 1130 is shown to further include a data or text section 1134 with text or information that is legible from the exterior of the container 1000 (such as product information, a UPC label, or the like) and the section 1134 generally would be provided on a translucent or opaque background that obscures viewing of image 129. As with framing element 130 of FIG. 2, the framing element 1130 includes an inner surface 1140 upon which background images 1144 are provided (but these images 1144 may be provided separately on or in front sidewall 114 or spaced apart from sidewall 114 between view sidewall 114 and reflective surface 128). The positioning of the images 1144 relative to the viewing port 1138 is chosen such that the images 1144 are reflected from the surface 128 through the viewing port 1138. In some embodiments, the images 1144 are provided a distance above a plane bisecting the primary image that matches or approximates a distance below such a bisecting plane at which the viewing port 1138 is provided on the front portion 114 of container 1000. In this manner, the primary image 129 is viewable through the viewing port 1138 concurrently with reflections of the background images 1144. In other embodiments, a viewing port may be provided on an upper portion of the framing element 1130 with background images being positioned on a lower portion of the framing element 1130. In other cases not shown, multiple viewing ports are provided to produce a desired visual effect from multiple viewing angles. For example, three viewing ports may be provided to provide effects at high, eye level, and low viewing or camera angles.

I claim:

1. A container for creating a visual effect, comprising:

a sidewall comprising a front portion and a rear portion distal to the front portion, wherein at least a portion of the front and rear portions is at least translucent to light; and a visual display assembly on a surface of or within the sidewall, the assembly comprising a mirror element proximate to the rear portion of the sidewall and including a reflective surface proximate to the surface of the sidewall and a primary image proximate to the reflective surface and the surface of the sidewall and spaced apart from the front portion of the sidewall, wherein the reflective surface faces toward the front portion of the sidewall and the reflective surface and the primary image are concurrently and directly visible through the front portion of the sidewall, wherein the visual display assembly further comprises a framing element on the front portion of the sidewall, the framing element comprising one or more background images.

2. The container of claim 1, wherein the surface of the sidewall is an exterior surface of the sidewall.

3. The container of claim 1, wherein the primary image is positioned between the reflective surface and the surface of the sidewall.

4. The container of claim 1, wherein the primary image is a printed image provided on the reflective surface.

5. The container of claim 1, wherein the sidewall at the rear portion is curved and the reflective surface and the primary image are on the sidewall conforming to the curved rear portion.

6. The container of claim 5, wherein the sidewall has a circular cross section.

7. The container of claim 1, wherein the visual display assembly further comprises a framing element on the front portion of the sidewall, the framing element comprising an image obscuring area that at least obscures viewing through the front portion of the sidewall and comprising a viewing area within the image obscuring area that is substantially transparent to light.

8. The container of claim 1, wherein the framing element further includes a substantially transparent viewing window free of the background images.

9. The container of claim 8, wherein the framing element further comprises a foreground image defining outer boundaries of the viewing window and wherein the foreground image shields the background images from direct view through the framing element, wherein the background images are visible through the viewing window via the reflective surface.

10. The container of claim 1, wherein the mirror element and the framing element are provided on one or more labels attached to the exterior surface of the container sidewall.

11. The container of claim 1, wherein the container further contains a translucent or substantially transparent substance in the interior space between the front and rear portions.

12. A container for creating a multi-dimensional visual display, comprising:

a sidewall comprising at least two portions including a rear sidewall opposite a front sidewall;

a primary image element proximate to the rear sidewall;

a reflective surface proximate to the rear sidewall and the primary image element; and a framing element proximate to the front sidewall, the framing element comprising background Image elements on the framing element, wherein a view of the primary image element and the background image elements, via the reflective surface, is provided by the container and wherein the primary image is positioned between the reflective surface and the front sidewall such that the primary image blocks reflection from a portion of the reflective surface.

13. The container of claim 12 wherein the framing element further comprises a viewing port defining a window through which a line of sight is provided to the primary image element and the adjacent reflective surface.

14. The container of claim 13, wherein the primary image element comprises a layer of ink defining an image that is printed onto the reflective surface.

15. The container of claim 12, wherein the rear sidewall has a semi-circular cross section and reflective surface and the primary image element have a curvature based on the semi-circular cross section of the rear sidewall.

16. The container of claim 12, wherein a label includes the framing element and the label extends about the periphery of the container as defined by the front and rear sidewalls.

17. A packaging system for providing visual effects, comprising:

a bottle comprising a sidewall that is at least translucent to light;

a reflective surface on a first portion of the sidewall and a primary image proximate to the reflective surface, wherein the reflective surface is positioned proximate to the first portion of the sidewall;

a background image proximate to a second portion of the sidewall and spaced apart from the primary image, wherein the background image is visible in the reflective surface; and a view port that is substantially transparent and positioned on the sidewall directly opposite the primary image across a void defined by inner surfaces of the sidewall.

18. The packaging system of claim 17, wherein the background image is visible in the reflective surface concurrently with the primary image.

19. The packaging system of claim 17, further comprising an opaque frame defining the view port, with the background image being positioned between the frame and the sidewall.

20. The packaging system of claim 19, further comprising a foreground image applied to the opaque frame, whereby the foreground image, the primary image, and the background image are concurrently visible in the system.

21. The packaging system of claim 17, wherein the background image comprises an image printed in a mirror image format.

22. The packaging system of claim 17, wherein the bottle has a non-planar cross section at least in the first portion of the sidewall.

23. A label for use with a container for achieving a visual effect, comprising:

an interior surface for contacting a sidewall of the container;

an exterior surface for positioning distal to the container sidewall;

a framing element provided on a first portion of a substrate comprising a substantially transparent viewing area and at least one background image; and a mirror element comprising a reflective surface provided on a second portion of the substrate, wherein the reflective surface is positioned on the container sidewall opposite the framing element when the label is applied to the container, wherein the mirror element further comprises a primary image applied to the reflective surface.

24. The label of claim 23, wherein the interior and exterior surfaces are on the substrate and the substrate is substantially transparent.

25. The label of claim 23, wherein the at least one background image is on the interior surface.

26. The label of claim 23, wherein the at least one background image is on the exterior surface.

27. The label of claim 23, wherein the at least one background image is on an embedded surface.

28. The label of claim 23, wherein the primary image and the background images comprise ink applied to the reflective surface and interior surface, respectively.

29. The label of claim 23, wherein the framing element further comprises foreground images visible on the exterior surface of the substrate, the foreground images being positioned outside the viewing area.

* * * * *

UNITED STATES PATENT AND TRADEMARK OFFICE

CERTIFICATE OF CORRECTION

PATENT NO. : 7,703,226 B2
APPLICATION NO. : 11/463951
DATED : April 27, 2010
INVENTOR(S) : Gary Schnuckle It is certified that error appears in the above-identified patent and that said Letters Patent is hereby corrected as shown below:

Column 23, line 18, delete "Image", and insert therefor --image--.

Signed and Sealed this

Twenty-ninth Day of June, 2010

David J. Kappos

David J. Kappos
*Director of the United States Patent and Trademark Office*